US009714634B2

(12) United States Patent
Leister et al.

(10) Patent No.: US 9,714,634 B2
(45) Date of Patent: Jul. 25, 2017

(54) ELECTROMAGNETIC VALVE FOR CONTROLLING AN INJECTOR OR FOR REGULATING PRESSURE OF A HIGH-PRESSURE FUEL ACCUMULATOR

(75) Inventors: Jens Leister, Kornwestheim (DE); Marco Beier, Stuttgart-Feuerbach (DE); Pierre Marie Rochas, Villeurbanne (FR); Oliver Rain, Ruthesheim (DE)

(73) Assignee: Robert Bosch GmbH, Stuttgart (DE)

( * ) Notice: Subject to any disclaimer, the term of this patent is extended or adjusted under 35 U.S.C. 154(b) by 739 days.

(21) Appl. No.: 12/959,053

(22) Filed: Dec. 2, 2010

(65) Prior Publication Data

US 2011/0127357 A1 Jun. 2, 2011

(30) Foreign Application Priority Data

Dec. 2, 2009 (FR) ..... 09 05823

(51) Int. Cl.

| | |
|---|---|
| ***F02M 63/00*** | (2006.01) |
| ***F02M 51/06*** | (2006.01) |
| ***F02M 61/16*** | (2006.01) |
| *F02M 47/02* | (2006.01) |

(52) U.S. Cl.

CPC ..... *F02M 63/0015* (2013.01); *F02M 51/061* (2013.01); *F02M 61/166* (2013.01); *F02M 63/007* (2013.01); *F02M 63/0075* (2013.01); *F02M 47/027* (2013.01); *F02M 2200/07* (2013.01)

(58) Field of Classification Search

CPC ..... F02M 63/0015; F02M 47/027; F02M 51/061; F02M 61/166; F02M 63/007; F02M 63/0075; F02M 2200/07

USPC ..... 239/585.1–585.5

See application file for complete search history.

(56) References Cited

U.S. PATENT DOCUMENTS

| | | | | |
|---|---|---|---|---|
| 4,917,352 | A * | 4/1990 | Hauet et al. | 251/129.19 |
| 5,295,627 | A | 3/1994 | Wahba | |
| 5,560,549 | A * | 10/1996 | Ricco et al. | 239/533.8 |
| 6,119,966 | A | 9/2000 | Wagner et al. | |
| 6,380,832 | B2 * | 4/2002 | Oyama et al. | 335/281 |

(Continued)

FOREIGN PATENT DOCUMENTS

| | | |
|---|---|---|
| CN | 1231055 | 10/1999 |
| CN | 1325118 | 12/2001 |
| DE | 19938865 A1 | 2/2001 |

(Continued)

OTHER PUBLICATIONS

Search Report and Written Opinion from the French Patent Office for Application No. FR0905823 dated Jul. 16, 2010 (5 pages).

*Primary Examiner* — Christopher Kim

(74) *Attorney, Agent, or Firm* — Michael Best & Friedrich LLP

(57) ABSTRACT

Electromagnetic valve, particularly for controlling a fuel injector or for regulating the pressure of a high-pressure fuel accumulator, comprising a casing (2), an electromagnet (24, 25) formed of a yoke (24) and an electromagnetic coil (25) housed in the latter, and an armature (22) in one or more parts. An abutment disk (28) is provided between the transverse face of the armature (22) turned towards the yoke (24) and the transverse face facing the yoke (24), this abutment disk (28) being made of a magnetized or magnetizable material, particularly of a ferromagnetic material.

1 Claim, 6 Drawing Sheets

(56) References Cited

U.S. PATENT DOCUMENTS

| | | | | |
|---|---|---|---|---|
| 7,422,165 | B2 * | 9/2008 | Cernoia et al. | 239/585.1 |
| 2009/0266920 | A1 | 10/2009 | Dragone et al. | |

FOREIGN PATENT DOCUMENTS

| | | | |
|---|---|---|---|
| EP | 1967726 | A2 | 9/2008 |
| JP | 2005180407 | | 7/2005 |
| JP | 2006090191 | | 4/2006 |
| JP | 2007154855 | | 6/2007 |
| WO | 03/002868 | A1 | 1/2003 |
| WO | 2009/124789 | A1 | 10/2009 |

* cited by examiner

ELECTROMAGNETIC VALVE FOR CONTROLLING AN INJECTOR OR FOR REGULATING PRESSURE OF A HIGH-PRESSURE FUEL ACCUMULATOR

BACKGROUND OF THE INVENTION

The present invention relates to an electromagnetic valve, particularly for controlling a fuel injector or for regulating the pressure of a high-pressure fuel accumulator, comprising a casing, an electromagnet formed of the yoke and an electromagnetic coil housed in the latter, and an armature in one or more parts.

The invention also relates to a fuel injector or a high-pressure fuel accumulator fitted with an electromagnetic valve as defined above.

Such an electromagnetic valve is used amongst other things for controlling the pressure of the fuel in the control chamber of a fuel injector, for example of an injector of a common rail injection system. With such electromagnetic valves, with the pressure of the fuel in the control chamber of the electromagnetic valve, controls the movement of the valve closure member (injector needle) with which the injection nozzle of the fuel injector is opened or closed.

According to document DE 198 32 826 A1, an electromagnetic valve for controlling a fuel injector is known. The electromagnetic valve comprises a casing accommodating an electromagnet, and a movable armature acted upon by the force developed by a valve spring, and a closure member made on the armature or interacting with the latter and pushed against a seat of the electromagnetic valve by the force developed by the valve spring. The electromagnet makes it possible to open and close the electromagnetic valve in order to thus regulate the outlet of fuel from the control chamber.

In the case of the known electromagnetic valve according to document DE 198 32 826 A1 above, the armature has a portion that is in relief in the shape of a collar on its face turned towards the electromagnet and that rests against a casing portion surrounding the electromagnet in the final position when the electromagnet is attracted; the height of this collar defines the residual air gap between the electromagnet and the transverse face of the armature.

Document U.S. Pat. No. 5,295,627 A1 describes an electromagnetic valve having a thin disk between the armature and an electromagnet. This thin disk limits the travel along which the armature can come closer to the electromagnet and thus defines the residual air gap. This disk is made of a non-magnetizable material and it is called a residual air gap disk.

Document DE 10 131 199 A1 describes an electromagnetic valve in which the transverse face of the armature or the polar surface of the electromagnet turned in a corresponding manner comprises a portion in relief made of a non-magnetoconducting material, for example a coating defining the minimum distance between the magnetoconducting surfaces of the electromagnet and the armature.

All these exemplary embodiments have in common that they have a "residual air gap", that is to say that they define a non-magnetoconducting distance between the armature and the electromagnet which prevents the armature from sticking against the electromagnet. The fuel in the gap between the armature and the electromagnet operates as the elements come closer like a hydraulic damper. The disk forming a residual air gap between the transverse face and the electromagnet and the opposite transverse face of the armature also makes it possible to adjust this hydraulic damping.

SUMMARY OF THE INVENTION

The present invention relates to an electromagnetic valve of the type defined above, characterized in that an abutment disk is provided between the transverse face of the armature turned towards the yoke and the transverse face facing the yoke, this abutment disk being made of a magnetized or magnetizable material, particularly of a ferromagnetic material.

The invention also relates to a fuel injector fitted with such an electromagnetic valve or a high-pressure fuel accumulator fitted with such an electromagnetic valve as a pressure regulator.

With respect to the prior art, the electromagnetic valve has the advantage that, for one and the same dimension, the valve provides a greater magnetic force and makes it possible to adapt the hydraulic damping better to the requirements to which the electromagnetic valve must respond. The choice of the materials of the yoke, of the abutment disk and of the armature makes it possible to prevent the magnetic sticking or at least the choice of the valve spring makes it possible to reduce the effects of the magnetic sticking. Moreover, the polar surface not covered by the abutment disk and its distance are available as parameters for adjusting the magnetic sticking effect. If the inner pole or the outer pole of the yoke is totally or partially covered by the abutment disk, for example by the appropriate geometric dimensions of the abutment disk, a magnetic short circuit is prevented. This can be done, for example, through the thickness of the abutment disk or the shape given thereto. Another advantage of the electromagnetic valve according to the invention is that it provides another magnitude of influence in the shape of the abutment disk so as to better adapt the magnetic force and the performance to the requirements made of the solenoid valve.

According to one advantageous feature, in at least one predefined operating state of the electromagnetic valve, the armature is applied at least with a portion of surface, without leaving an air gap, against the abutment disk of the electromagnetic valve.

This makes it possible to use the magnetic force, particularly in the final position, in an optimal manner in order to overcome the force developed by the valve spring which acts against the magnetic force on the armature and on the member for closing the electromagnetic valve, a member connected to the armature; specifically, no additional energy is required for such a residual air gap which subsists between the armature and the yoke. Particularly in the hold phase, that is to say when the electromagnetic valve is open and the armature is applied in its end-of-travel position against the abutment disk, it is possible to reduce the currents for holding the electromagnetic valve, which reduces the stresses applied to the electronic components of a control device. Moreover, the whole electromagnetic valve can have reduced dimensions by virtue of the greater magnetic forces in comparison with those of an electromagnetic valve of the same dimensions according to the prior art, which can be used to have better performance of the electromagnetic valve and/or to reduce the space requirement. This can be used to have a greater power density of the engine and/or better transmission coefficients and/or better protection against accidents, in particular safety in the event of a collision with a person falling onto the engine hood. At the same time, it reduces the consumption of material and hence the cost of the electromagnetic valve.

According to another advantageous development, the electromagnetic valve is characterized in that the abutment disk protrudes laterally beyond the yoke, and, in at least one operating state, it is applied against the casing and thus transmits at least partly the impact forces to the casing.

Therefore, the kinetic energy at the time of the impact of the armature is at least partly transmitted to the casing. This development makes it possible to reduce the mechanical forces exerted on the yoke which can therefore be made of a softer material than that of the abutment disk and optimized from the point of view of its magnetic properties for the yoke. This prevents or at least greatly reduces premature wear of the yoke by virtue of this at least partial transfer of the forces at the time of the impact of the armature via the abutment disk to the casing.

According to another advantageous development, the electromagnetic valve is characterized in that the abutment disk is placed between the inner pole of the yoke and the armature.

The placement between the inner pole of the yoke and the magnetic armature in the case of a one-piece abutment disk also has the advantage of an abutment disk with a smaller diameter and thus, on the one hand, of having only a small surface of the yoke that is covered, thus greatly reducing the magnetic sticking and, on the other hand, this disk is made with little material which corresponds to a low-cost solution.

According to another advantageous development, the electromagnetic valve is characterized in that the abutment disk is placed between the outer pole of the yoke and the armature. This solution has the advantage that additional parts are not installed at the points of connection between the armature and the valve closure member or of producing an additional part in this location. This makes it easier to achieve the combination of the armature and of the valve closure member and simplifies the mounting of the electromagnetic valve.

According to another advantageous development, the electromagnetic valve is characterized in that the abutment disk only partially covers an adjacent inner pole or an outer pole of the yoke for its transverse face turned towards the abutment disk.

By virtue of this only partial overlap of one or of both poles of the yoke, the contact surface is reduced between the abutment disk and the yoke. This reduces possible residual magnetic sticking and, moreover, by virtue of the only partial overlap of one or of both poles of the yoke, the magnetic-field lines are concentrated on the abutment disk in order to achieve a stronger local magnetic saturation and a greater energy density. This makes it possible to further optimize the magnetic forces.

According to another advantageous development, the electromagnetic valve is characterized in that the bearing surface of the abutment disk is reduced by at least one opening or cutout. Such an opening or cutout reduces the resultant contact surface between the abutment disk and the yoke in a simple and economic manner.

According to a particularly advantageous development, the electromagnetic valve is characterized in that at least one opening or cutout is made in the form of an orifice which is circular in particular. Such orifices are made economically and simply, for example by making a cutout in the abutment disk on a press; they reduce the resultant contact surface and thus the magnetic sticking.

According to another particularly advantageous development, the opening or the cutout is made in the form of a slot, preferably centered. This slot may constitute a variant of a circular orifice of the abutment disk or be provided in addition to at least one such circular orifice; this slot preferably has a length which extends over a large portion of the diameter of the abutment disk. This slot furthermore reduces the eddy currents in the section of the abutment disk and improves the dynamic commutation behavior of the electromagnetic valve.

According to another advantageous development, the abutment disk completely covers the adjacent inner pole or the outer pole of the yoke, at its transverse surface turned towards the abutment disk or else extends past its poles. This shape given to the section of the abutment disk allows the magnetic-field lines on the abutment disk to better follow the contour of the transition between the armature, the abutment disk and the yoke, which results in a higher overall magnetic force of the electromagnetic valve. Moreover, a portion of the kinetic energy produced during the impact of the armature can be dispersed in the casing and can therefore discharge the magnetic core.

A fuel injector fitted with an electromagnetic valve according to the invention has the advantage with respect to the prior art of increasing its speed of commutation and of sealing of the fuel injector; this also makes it possible to reduce the current necessary for the control. It is also possible to meter the injected quantities better and increase the accuracy of control of the fuel injector. The increase in speed of commutation and the reduction in current consumed also increase the possibilities of application of such a fuel injector.

A high-pressure (common rail) fuel accumulator fitted with an electromagnetic valve according to the invention in order to regulate the pressure thereof provides the advantage of improving the seal of the valve, particularly at high pressures, because the higher magnetic force makes it possible to regulate a higher hold-closed force for the member for closing off the electromagnetic valve. With respect to the future high-pressure fuel accumulators which will be designed for pressures higher than 2000 bar, it has a certain advantage. At the same time, the electromagnetic valve will be functionally very robust with respect to the particles. The electromagnetic valve according to the invention makes it possible to increase the accuracy of regulation of the pressure in the high-pressure fuel accumulator.

BRIEF DESCRIPTION OF THE DRAWINGS

The present invention will be described below in greater detail with the aid of exemplary embodiments of an electromagnetic valve represented in the appended drawings in which.

DETAILED DESCRIPTION

Figure 1:
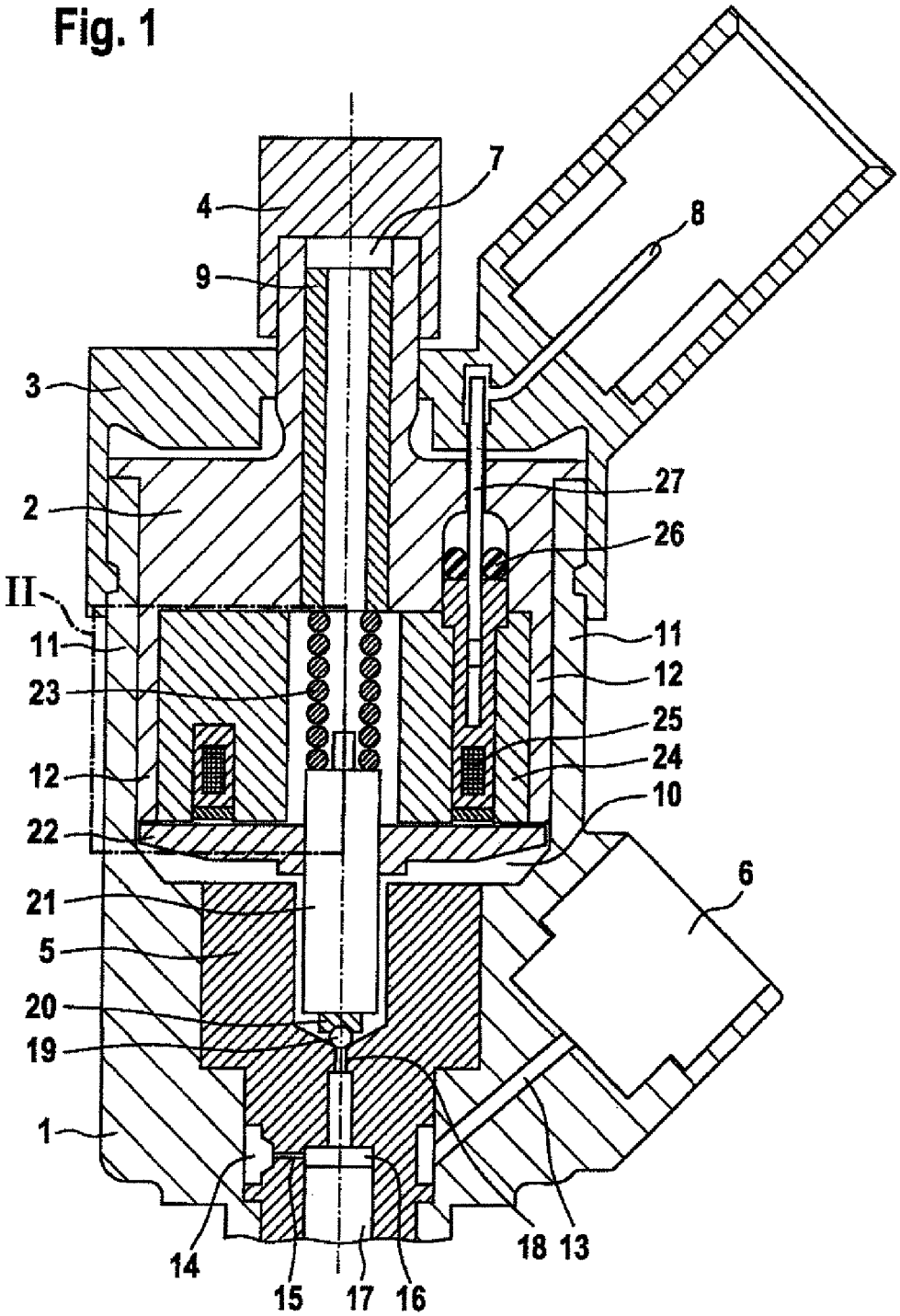
PRIOR ART Fig. 1
FIG. 1 shows in longitudinal section an electromagnetic valve according to the prior art applied to the example of a fuel injector.

FIG. 1 shows an exemplary embodiment of an electromagnetic valve as used many times in fuel injectors. The electromagnetic valve consists of a casing 1, 2, the lower portion 1 of which is in a single piece with the body of the fuel injector. As a variant, the electromagnetic valve may also form an independent module installed on a fuel injector or incorporated into a fuel injector. The transverse face of the lower portion 1 of the casing comprises a pot-shaped cavity delimited by spacers 11 parallel to the longitudinal axis of the electromagnetic valve. This pot-shaped cavity accommodates two other parallel spacers 12 made on the transverse face of the upper portion 2 of the casing, these spacers being engaged so as to thus form a chamber 10. The bottom side of the chamber 10 comprises a cavity accommodating a valve part 5. The side of the lower portion 1 of the casing comprises a high-pressure connection 6 connected to a channel 13 with an annular volume 14. The annular volume 14 is delimited by the lower portion 1 of the casing and by the valve part 5 and this volume is linked via a throttled inlet passage 15 to a control chamber 16. The control chamber 16 is delimited by the valve part 5 and by a valve piston 17. Opposite to the transverse face of the valve piston 17 delimiting the control chamber 16, the valve part comprises a throttled outlet passage 18. This throttled outlet passage 18 is closed by a ball forming a valve 19 when the electromagnetic valve is not actuated. The ball forming the valve 19 is locked in its position by means of a ball guide 20 and by the force developed by a valve spring 23, by means of a valve closure member 21 in order to be pushed against the valve part 5 so that no fuel can leave the control chamber 16 by passing through the throttled outlet passage 18. The ball guide 20 and the ball forming the valve 19 can also be produced on the valve closure member 21 as an alternative. Similarly, it is possible to envisage a guidance of one side of the valve closure member 21 with a half-ball in place of the valve ball 19, which removes any additional guidance 20 of the ball. As a variant, the electromagnetic valve can also be a pressure-balanced electromagnetic valve.

The chamber 10 houses an electromagnet 24, 25 consisting of a magnetic core or of the yoke 24 and of an electromagnetic coil 25. The electromagnetic coil 25 comprises a contact pin 27 coming out of the upper portion 2 of the casing in a sealed manner with respect to the outside at the chamber 10 by means of a sealing element 26. The contact pin 27 is connected to a contact element 8 which, with the contact pin 27, forms an electric contact 8, 27 of the solenoid valve. To isolate the electric contact 8, 27, the upper portion 2 of the casing is closed by a cap 3 preferably made in the form of an injected cap. The upper portion 2 of the casing comprises at its center a drill hole 28 receiving a sleeve 9 serving as an abutment to the valve spring 23 and making it possible to adjust the prestress of the valve spring. As a variant, the spring can be adjusted for example by using appropriate adjustment shims. The sleeve 9 makes it possible to divert the leakages from the solenoid valve by passing through another hood 4 in the return 7.

When the electromagnet 24, 25 is controlled by the electric contact 8, 27, a magnetic force is developed between the yoke 24 and the armature 22. This magnetic force attracts the armature 22 which interacts directly with the valve closure member 21 and thus releases the throttled outlet passage 18 of the valve part; this allows the injector to inject fuel in a known manner. As a variant, the injector closure member 21 can be formed on the armature 22.

Figure 2:
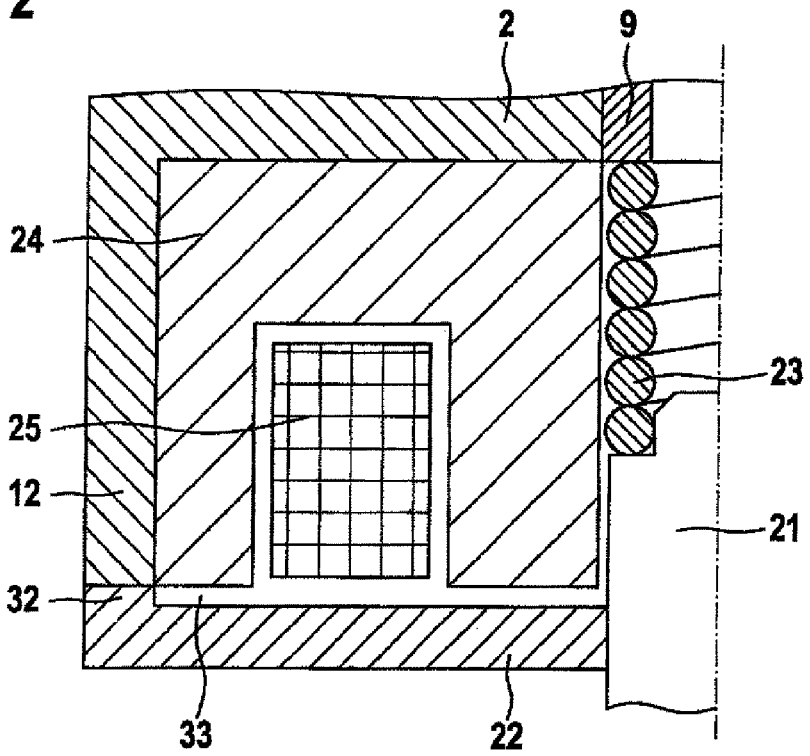
PRIOR ART Fig. 2
FIG. 2 is a detail on a larger scale of the electromagnetic valve of FIG. 1.

To prevent the armature 22 sticking to the yoke 24, as shown in FIG. 2, on the outside the armature 22 has a collar 32 against which the armature butts the spacer 12 of the upper portion 2 of the casing when the electromagnetic valve is controlled. It thus forms a residual air gap 33 between the yoke 24 and the armature 22. This residual air gap prevents the armature 22 sticking magnetically to the yoke 24.

As a variant, also known are spacing elements, made of a non-magnetic or non-magnetizable material, installed between the armature 22 and the yoke 24 in order to prevent magnetic sticking.

Figure 3A:
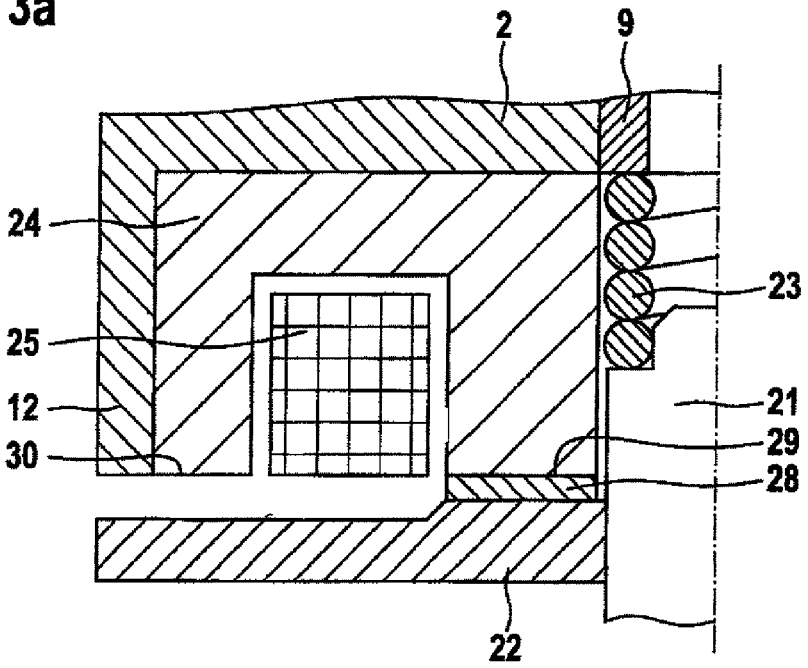
FIGS. 3*a*-3*c* show on a larger scale a detail of the electromagnetic valve furnished with the magnetizable abutment disk according to the invention.

FIG. 3*a* shows a first exemplary embodiment of the electromagnetic valve according to the invention furnished with a magnetic or magnetizable abutment disk 28, in particular a ferromagnetic shim. The abutment disk is placed between the armature 22 and the inner pole 29 of the yoke 24.

In operation of the electromagnetic valve, when closed, there is a gap between the electromagnetic armature 22 and the bearing shim 28 or between the abutment disk 28 and the yoke 24. Usually, this distance defines the maximum travel of the electromagnetic valve. In the operating position of the electromagnetic valve when completely open, the armature 22 and the abutment disk 28 and the abutment disk 28 and the yoke 24 are at least in contact via surface portions. Therefore, when the electromagnetic valve is open, there is an uninterrupted magnetic flux between the inner pole 29 of the yoke 24 and the armature 22 through the abutment disk 28. This uninterrupted magnetic flux gives to the electromagnetic valve according to the invention a higher magnetic force even for an identical space requirement. The contact surfaces that remain between the yoke 24 and the abutment disk 28 or between the abutment disk 28 and the armature 22 are then small enough so that, when the electromagnet (24, 25) has finished being powered, the residual magnetic force is significantly less than the force of the valve spring 23; this allows a rapid and clean break between the armature 22 and the bearing shim 28 or between the bearing shim 28 and the yoke 24.

Figure 3B:
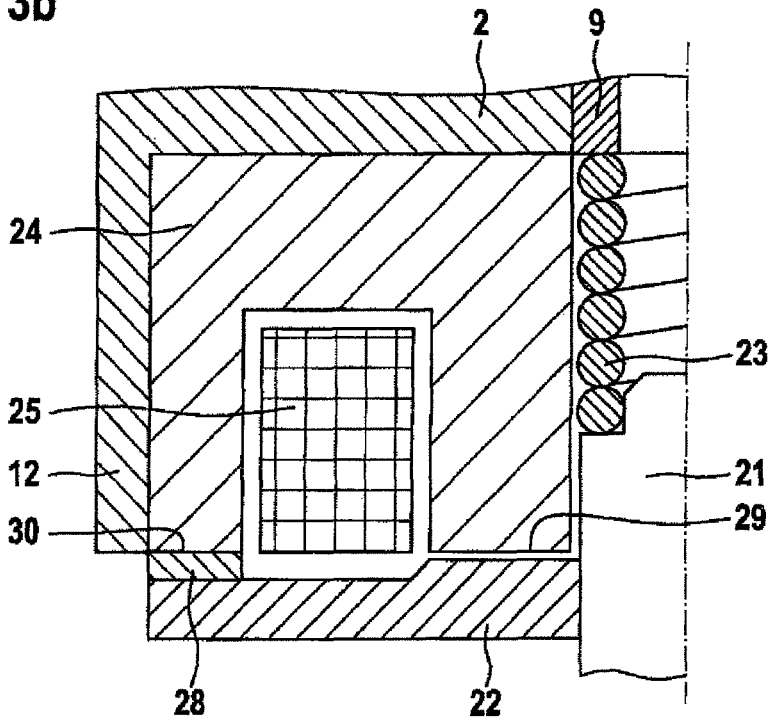
Figure 3C:
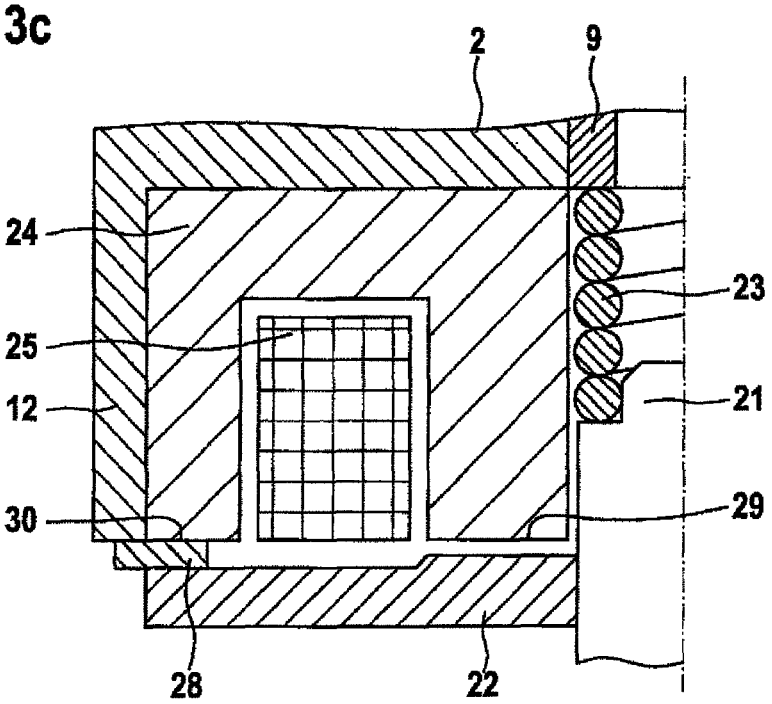

FIG. 3*b* shows another exemplary embodiment of the electromagnetic valve according to the invention comprising a magnetic or magnetizable, particularly ferromagnetic, abutment disk 28. The abutment disk 28 is placed between the armature 22 and the outer pole 30 of the yoke 24. As a variant, the abutment disk 28 can also be moved outwards in the direction of a portion of casing 1, 2 as shown in FIG. 3*c*; therefore, the portion of the transverse surface of the outer pole 30 turned towards the inner pole no longer covers it so that the bearing shim 28 is applied via its transverse face away from the yoke against the armature 22 and via its transverse face turned towards the armature 24, it overlaps the casing 1, 2 and in the operating position, with the solenoid valve open, and it rests against the spacer 12 of the upper portion 2 of the casing and against the yoke 24. As a variant, the abutment disk 28 may also be shaped to completely cover the outer pole 30 and protrude beyond it in the direction of the casing 1, 2. This arrangement also offers the possibility of diverting the abutment forces to a very large degree in order to pass beside the yoke 24 through the spacer 12, which reduces the mechanical stress of the yoke 24.

Figure 4A:
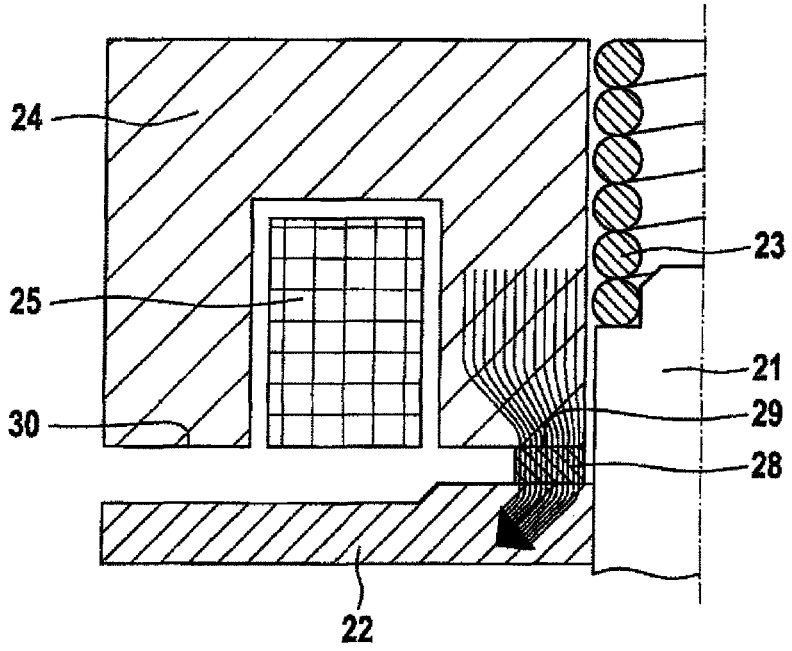
FIGS. 4*a*-4*b* show other exemplary embodiments of the detail of an electromagnetic valve with a magnetizable abutment disk according to FIGS. 3*a* and 3*b*, FIGS. 5*a*-5*c* show other exemplary embodiments of the magnetizable disk according to the invention.

FIG. 4*a* shows an advantageous development of the exemplary embodiment shown in FIG. 3*a* according to which the abutment disk 28 is placed, in the open operating state of the electromagnetic valve, between the inner pole 29 of the yoke 24 and the armature 22; the abutment disk 28 however covers only a fraction of the surface of the inner pole 29 of the yoke 24 along the direction of movement of the armature 22. In this context, the notion of overlap corresponds to the projection of the point of greatest extension of the abutment disk 28 on the surface of the yoke 24. This arrangement results in a denser combination of the magnetic-field lines in the portions of the yoke 24, which prevents an early magnetic saturation in the partial zones of the yoke 24 and generally results in a higher maximum magnetic force. In addition, the zone of the contact surfaces between the armature 22, the abutment disk 28 and the yoke 24 is thus reduced, which similarly reduces the risk of inconvenient magnetic sticking.

Such an abutment disk 28 with a small zone of overlap can also be placed between the outer pole 30 of the yoke 24 and the armature 22 and thus pass beyond the outer pole so that the abutment disk rests at least partly against the spacer 12 of the upper portion 2 of the casing.

Figure 5A:
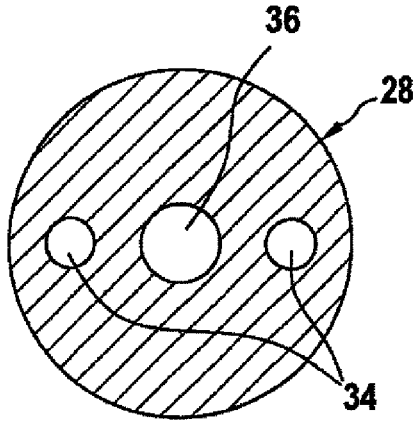

FIG. 5*a* shows another exemplary embodiment of the abutment disk 28. In this example, the contact surface between the abutment disk 28 and the yoke 24 or between the abutment disk 28 and the armature 22 is reduced by openings preferably in the form of circular orifices 34. As a variant, these orifices 34 obtained simply by cutting out on a press from the abutment disk 28 may also have any other geometric shape, in particular an oval, rectangular, hexagonal, diamond or star shape. These orifices 34 may also serve as a variant for the drill hole for access to the contact pins 27 for the connection of the coil 25 of the electromagnet 24, 25. Moreover, the abutment disk 28 comprises a central drill hole 36 in which the member 21 for closing off the electromagnetic valve moves.

Figure 5B:
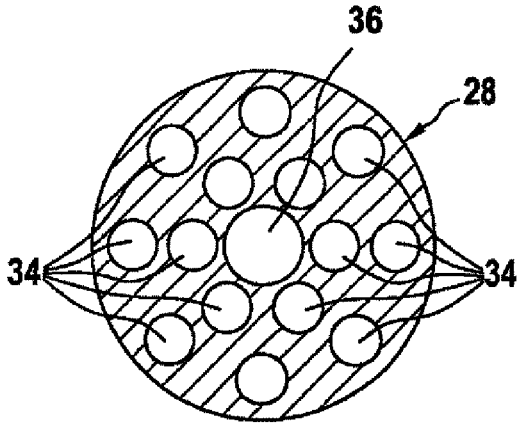

FIG. 5*b* shows as a variant an abutment disk having many orifices 34; the bearing surface of the abutment disk 28 against the armature 22 and against the yoke 24 is yet more reduced, which further reduces the residual magnetic sticking.

Figure 5C:
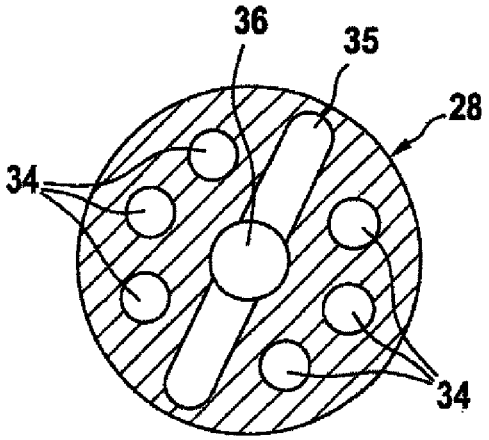

FIG. 5*c* shows another preferred exemplary embodiment of the abutment disk 28; in addition to the circular orifices 34, this disk also comprises another opening in the form of an elongated slot 35. This slot is preferably centered in the abutment disk 28. This means that the slot preferably passes through the axis of the abutment disk 28 in order to divide the abutment disk 28 into two halves of the same dimensions and accordingly reduce the eddy currents in the abutment disk 28, which improves the performance of the establishment and reduction of the magnetic forces in the electromagnetic valve.

Figure 4B:
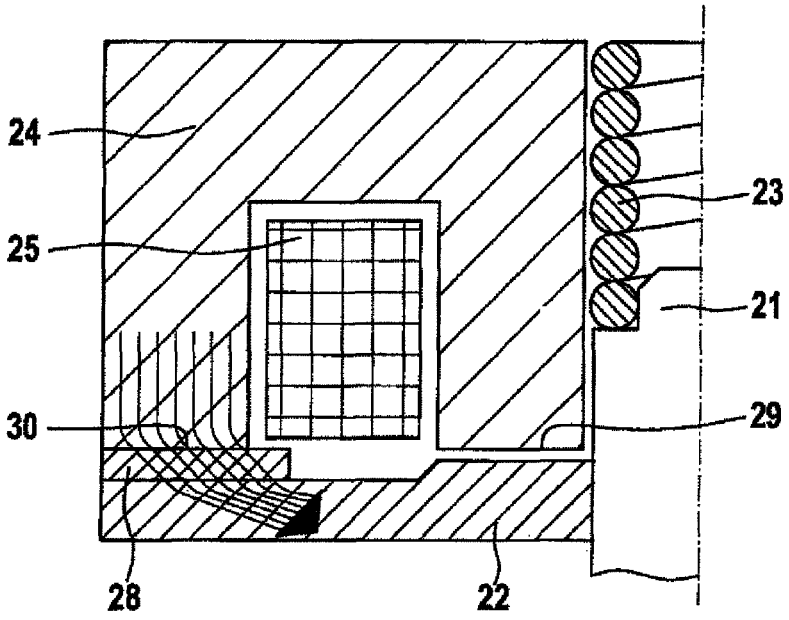

FIG. 4*b* shows an advantageous development of the exemplary embodiment of FIG. 3*b*; this example comprises an abutment disk 28 installed between the outer pole 30 of the yoke 24 and the armature 22, completely covering the surface of the outer pole 30 and/or protruding beyond the transverse surface of the outer pole 30. "Overlapping" in this instance means the projection of the point of greatest extension of the abutment disk over the transverse face of the yoke. This arrangement of the abutment disk 28 makes it possible to spread the magnetic-field lines more widely in the portions of the yoke 24, which maximizes in particular the magnetic flux between the yoke 24, the abutment disk 28 and the armature 22. In addition, it makes it possible to reduce the mechanical stresses exerted on the yoke 24 at the time of the impact of the armature 22, because the mechanical forces are directed by the abutment disk 28 which protrudes into the casing 1, 2, particularly into the upper portion 2 of the casing. Such an abutment disk 28, which covers a larger surface than the surface of the adjacent pole 29, 30 of the yoke 24, can also be installed between the armature 22 and the inner pole 29 in order to optimize the magnetic flux in this zone or to carry away the mechanical forces at the time of the impact of the armature 22 to the casing 1, 2, particularly to the upper portion 2 of the casing.

Figure 6:
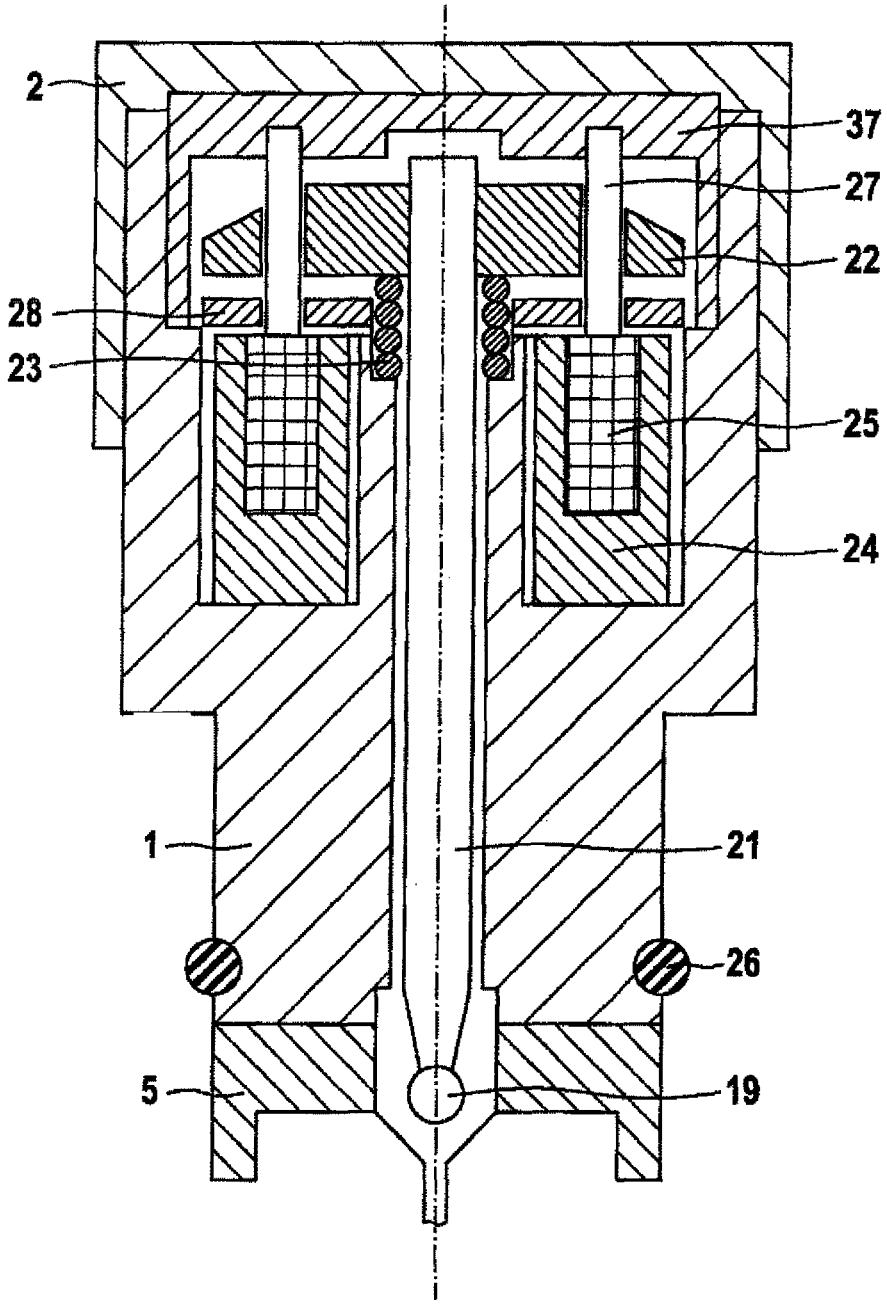
FIG. 6 shows a pressure-regulation valve furnished with a magnetizable abutment disk according to the invention.

FIG. 6 is a longitudinal section of an electromagnetic valve for regulating pressure in a high-pressure fuel accumulator comprising an abutment disk 28 according to the invention. The use of a magnetized or magnetizable abutment disk 28 in the electromagnetic valve reduces the air gap between the armature 22 and the yoke 24 without in parallel also reducing the hydraulic air gap between the armature 22 and the yoke. This increases the magnetic force developed by the electromagnetic valve without reducing the weakness of the electromagnetic valve with respect to the particles. Increasing the magnetic force increases the force for holding the closure member 21 of the electromagnetic valve and thus produces a higher seal of the electromagnetic valve. In addition, the upper portion 2 of the casing can accommodate an insert 37 limiting the travel of the armature 22.

COMPONENT LIST

1 Lower portion of the casing
2 Upper portion of the casing
5 Valve part
6 High-pressure connection
10 Chamber
11 Spacers
12 Spacers
13 Channel
14 Annular volume
15 Throttled inlet passage
16 Control chamber
17 Valve piston
18 Throttled outlet passage
19 Ball forming valve
20 Ball guide
21 Closure member
22 Armature
23 Valve spring
24 Yoke
25 Electromagnetic coil
26 Sealing element
27 Contact pin
28 Abutment disk
29 Inner pole
30 Outer pole
34 Orifice
35 Elongated slot
36 Central drill hole
37 Insert

The invention claimed is:

1. An electromagnetic valve, comprising: a casing (1, 2), an electromagnet (24, 25) formed of a yoke (24) and an electromagnetic coil (25) housed in an opening of the yoke, and an armature (22) in one or more parts, the yoke (24) opening towards the armature (22), characterized in that an abutment disk (28) is provided between on one hand a transverse face of the armature (22), said face of the armature (22) being turned towards the yoke (24), and on the other hand a transverse face of the yoke (24), the abutment disk (28) being made of a magnetized or magnetizable material, and in that a bearing surface of the abutment disk (28) is reduced by at least two orifices (34, 35, 36), wherein at least one of the at least two orifices (36) has a different size than the remaining orifices (34, 35), characterized in that the bearing surface of the abutment disk (28) is further reduced by a central drill hole (36).

* * * * *